US010015983B2

(12) United States Patent
Sha et al.

(10) Patent No.: US 10,015,983 B2
(45) Date of Patent: Jul. 10, 2018

(54) USE OF SALING AQUEOUS SOLUTION AS HYDRATED HUMECTANT FOR TOBACCO STEM

(71) Applicant: Shanghai Tobacco Group Co., LTD., Shanghai (CN)

(72) Inventors: Yunfei Sha, Shanghai (CN); Jiaying Lou, Shanghai (CN); Da Wu, Shanghai (CN); Baizhan Liu, Shanghai (CN); Bin Yang, Shanghai (CN)

(73) Assignee: SHANGHAI TOBACCO GROUP CO., LTD, Shanghai (CN)

( * ) Notice: Subject to any disclaimer, the term of this patent is extended or adjusted under 35 U.S.C. 154(b) by 383 days.

(21) Appl. No.: 14/430,045

(22) PCT Filed: Apr. 7, 2013

(86) PCT No.: PCT/CN2013/073801
§ 371 (c)(1),
(2) Date: Mar. 20, 2015

(87) PCT Pub. No.: WO2014/044044
PCT Pub. Date: Mar. 27, 2014

(65) Prior Publication Data

US 2015/0237911 A1 Aug. 27, 2015

(30) Foreign Application Priority Data

Sep. 20, 2012 (CN) ..... 2012 1 0352691

(51) Int. Cl.
*A24B 15/28* (2006.01)

(52) U.S. Cl.
CPC ..... *A24B 15/287* (2013.01)

(58) Field of Classification Search
USPC ..... 131/290, 300
See application file for complete search history.

(56) References Cited

U.S. PATENT DOCUMENTS 3,861,402 A * 1/1975 Briskin ..... A24B 15/165 131/359
5,095,922 A 3/1992 Johnson et al.
(Continued)

FOREIGN PATENT DOCUMENTS

CN 1985687 A 6/2007

OTHER PUBLICATIONS

Sodium Dihydrogen Phosphate Information Sheet, Food and Agriculture Organization of the United Nations, no date, [online], retrieved from the Internet. [retrieved Apr. 8, 2017], URL:http://www.fao.org/ag/agn/jecfa-additives/specs/Monograph1/Additive-403.pdf).*

(Continued)

*Primary Examiner* — Dennis R Cordray
(74) *Attorney, Agent, or Firm* — Global IP Services; Tianhua Gu

(57) ABSTRACT

A moistening method for tobacco stems comprises 1) preparing a hydrated humectant for tobacco stem, 2) placing cut tobacco stems in the hydrated humectant to form impregnated cut tobacco stems; 3) taking out and drying the impregnated cut tobacco stems; the hydrated humectant for tobacco stem is a saline aqueous solution of $A_nB$, the $A_nB$ is NaH2PO4, potassium gluconate or oxalic acid, and each one of the $A_nB$ has a weight-percent concentration of 0.05 wt % to 5 wt %.

5 Claims, 4 Drawing Sheets

(56) References Cited

U.S. PATENT DOCUMENTS

| | | | | |
|---|---|---|---|---|
| 5,681,826 | A * | 10/1997 | Shibuya | A21D 2/181 514/54 |
| 5,860,428 | A | 1/1999 | Lesser | |
| 2004/0131737 | A1 * | 7/2004 | Tomoda | A23L 5/27 426/438 |

OTHER PUBLICATIONS

Potassium Gluconate Information Sheet, Chemical Book, no date, [online], retrieved from the Internet. [retrieved Apr. 8, 2017], <URL:http://www.chemicalbook.com/ProductMSDSDetailCB6359168_EN.htm#2>.*

Hussain et al, "Solubility of Oxalic Acid", Asian J. Research Chem. 5(11): Nov. 2012, [online], retrieved from the Internet. [retrieved Apr. 8, 2017], <URL:https://www.researchgate.net/publication/281775607_Solubility_of_Oxalic_Acid>.*

* cited by examiner

USE OF SALING AQUEOUS SOLUTION AS HYDRATED HUMECTANT FOR TOBACCO STEM

CROSS REFERENCE TO RELATED PATENT APPLICATION

The present application is the US national stage of PCT/CN2013/073801 filed on Apr. 7, 2013 which claims the priority of the Chinese patent applications No. 201210352691.2 filed on Sep. 20, 2012, which applications are incorporated herein by reference.

BACKGROUND OF THE PRESENT INVENTION

1. Field of Invention

The present invention relates to the field of tobacco, and more particularly to a use of saline aqueous solution as a hydrated humectant for tobacco stem.

2. Description of Related Arts

During tobacco treatment process, the addition of a humectant has important effects for improving resistance to processability, transportation, warehousing, and sensuous comfort and stimulation of smoking for tobaccos. According to the mechanism of humectant, physical humectants for cigarettes mainly include three types: (1) hygroscopic humectants: this type of substances has relatively high hygroscopic property, which serves to absorb and retain moisture in cigarettes. The main components include polyol (e.g., glycerol, propylene glycol, sorbitol, etc.), tobacco itself, or hydrophilic substrates (e.g., carbohydrate, protein, pectin, etc.) contained in other plants, for example, an aldose and a derivative formula thereof reported in the Chinese Patent "NOVEL HUMECTANT FOR TOBACCO" (Application No. 98113287.1), and a konjac extract reported in the Chinese Patent "KONJAC HUMECTANT AND APPLICATION THEREOF IN CIGARETTES" (Application No. CN200910061990.9). (2) Blocking humectants, whose main components are grease-like, serve to form a blocking barrier on the tobacco surface and to prevent evaporation and dissipation of internal moisture. The blocking humectants include paraffin oil, vegetable oil, and natural oil extracts, such as the wax-type humectant for tobacco reported in the Chinese Patent "WAX-TYPE HUMECTANT FOR TOBACCO AND PREPARATION METHOD THEREOF" (Application No. CN101658323), and the multicarbon fatty alcohol and the formula of multicarbon fatty acid reported in the Chinese Patent "HUMECTANT FOR TOBACCOS" (Application No. CN201010142981.5). (3) Hydrated humectants, which may have a solvation effect with water, and are mainly some metal ion types such as a magnesium salt; however, this type of hydrated salts is usually insoluble in water and is difficult to apply, and there are very few reports on this type of humectants.

Tobacco leaves are loose porous materials and have relative high potentials for absorbing and dissipating moisture. Tobacco stems are rough and rigid veins of tobacco leaves, and features porousness, porosity, as well as equilibrium moisture content significantly greater than those of tobacco leaves, thereby having higher potentials for absorbing moisture; however, this part of moisture disappears easily, and the moisture thereof dissipates at a speed higher than that of tobacco leaves, and thus actually the moistening performance is even lower.

The raw material of tobacco stems has a rich content in pectin, which is often bonded with calcium ions and the like.

By adding with soluble inorganic or organic acids, or metal saline aqueous solution thereof, the calcium ions in the calcium pectate can be replaced and converted to generate hydrated calcium ions, such as calcium oxalate, mono/di-calcium phosphate, calcium citrate, calcium lactate, thereby effectively preventing the dissipation of moisture in tobacco, improving moistening performance of the tobacco stems. Currently, there are very few reports at home and abroad on a use of a hydrated humectant to improve moistening performance of cut stems.

SUMMARY OF THE PRESENT INVENTION

In view of the disadvantages in the prior art, the object to be solved of the present invention is to provide a hydrated humectant for tobacco stem, which serves to keep moisture in expanded cut stems.

A first aspect of the present invention provides a use of a saline aqueous solution as a hydrated humectant for tobacco stem. The saline aqueous solution is an aqueous solution of $A_nB$, wherein the cation A is selected from one of potassium, sodium, ammonium or hydrogen, the anion B is selected from one of hydrogen phosphate, dihydrogen phosphate, oxalate, lactate, citrate, malate, gluconate, and acetate. n is a positive integer, and is determined by a specific valence state of the cation A and the anion B.

Specifically, when B is dihydrogen phosphate, lactate, gluconate or acetate, n=1;

when B is hydrogen phosphate, oxalate or malate, n=2; and when B is citrate, n=3.

Preferably, the aqueous solution of $A_nB$ has a weight-percent concentration of 0.05 wt % to 5 wt %.

Preferably, the aqueous solution of $A_nB$ has a weight-percent concentration of 0.05 wt % to 2 wt %.

Preferably, $A_nB$ is $NaH_2PO_4$, potassium gluconate or oxalic acid.

A second aspect of the present invention provides an application of the hydrated humectant for tobacco stem in tobacco stems.

A third aspect of the present invention provides a moistening method for tobacco stems, where the saline aqueous solution $A_nB$ is used, and specifically comprises the following steps:

(1) preparing the aqueous solution of $A_nB$.

(2) adjusting the temperature of the solution obtained in step 1 to 10° C. to 90° C.

(3) placing cut stems in the solution obtained in step 2, where impregnation duration is 0.5 min to 30 min, and a material-to-solution ratio of the cut stems to the solution is g:L=1:10 to 100.

(4) taking out and drying the cut stems, and placing the cut stems in a constant temperature and humidity chamber in which the humidity is 57% to 63% and the temperature is 20° C. to 24° C., and keeping equilibrium for over 48 h.

Preferably, the temperature in step 2 is 20° C. to 40° C.

Preferably, the impregnation duration in step 3 is 0.5 min to 5 min.

According to the present invention, the saline aqueous solution serves as the hydrated humectant for tobacco stem, and the principle thereof is that: the saline aqueous solution is used to perform a substitution reaction with calcium citrate inside tobacco stems to generate a hydrated calcium salt (i.e., a calcium salt capable of carrying crystallization water), thereby preventing escape of water molecules, reducing evaporation and dissipation of moisture, and achieving a good moistening efficacy. Moreover, according to the present invention, the inorganic or organic acid, as well as a metal salt thereof are components of tobacco stems or common additives, which are safe, nontoxic, and easy to promote wide application.

According to the present invention, the prominent advantages and features lie in that:

(1) The hydrated humectant for tobacco stem is a soluble or readily soluble inorganic or organic acid, or an aqueous solution of a metal salt of the acid. By replacing the calcium ions in cells of tobacco stem itself to generate an insoluble or slightly soluble hydrated calcium salt in the pore, it enables to achieve a moistening effect.

(2) The hydrated humectant for tobacco stem has stable compatibility with tobacco stems, and is safe, nontoxic, and is easy to promote wide application.

(3) The hydrated humectant for tobacco stem has a simple preparation process. It merely requires for a soluble or readily soluble inorganic or organic acid, or a metal salt of the acid dissolving in deionized water to obtain a solution, for directly use in production (online equipment may control the temperature at 10° C. to 90° C.).

DETAILED DESCRIPTION OF THE PREFERRED EMBODIMENTS

The implementation manners of the present invention are described below by using specific examples. A person skilled in the art can readily learn other advantages and efficacy of the present invention from the content disclosed in the specification. The present invention can be further implemented or applied by using other different specific implementation manners, and various modifications or changes may also be made to various details in the specification based on different viewpoints and applications without departing from the spirit of the present invention.

It should be noted that conventional devices or apparatuses in the prior art are used for unspecified process devices or apparatuses in the embodiments. All pressure values and ranges are absolute pressure.

It should be understood that one or more method steps mentioned in the present invention, unless otherwise indicated, do not exclude that other method steps may further exist before or after the combination of steps or other method steps may further be inserted among these explicitly mentioned steps. It should be further understood that the combination or connection relationships among one or more devices/apparatuses mentioned in the present invention, unless otherwise indicated, do not exclude that other devices/apparatuses may further exist before or after the combination of devices/apparatuses or other devices/apparatuses may further be inserted between two explicitly mentioned devices/apparatuses. Moreover, unless otherwise indicated, the sequence number of each method step is only for ease of differentiating each method step rather to limit an arrangement order of each method step or limit the scope within which the present invention can be implemented, and changes or adjustments made to relative relationships among the method steps, as long as there is no substantial change to the technical content, should also be regarded as the scope within which the present invention can be implemented.

Embodiment 1

DVS-100T Advantage (SMS, England); Model KNF240 Constant Temperature and Humidity Chamber (BINDER, Germany); Analytical Balance (METTLER-TOLEDO, Switzerland, Sensibility: 0.0001 g); Scanning Electron Microscope (JEM-2100F, JEOL, Japan); EDX (JEM-2100F); Types of Cut Stem: provided by Shanghai Tobacco Group Co., Ltd.

1) Blank Control Cut Stems

Figure 1:
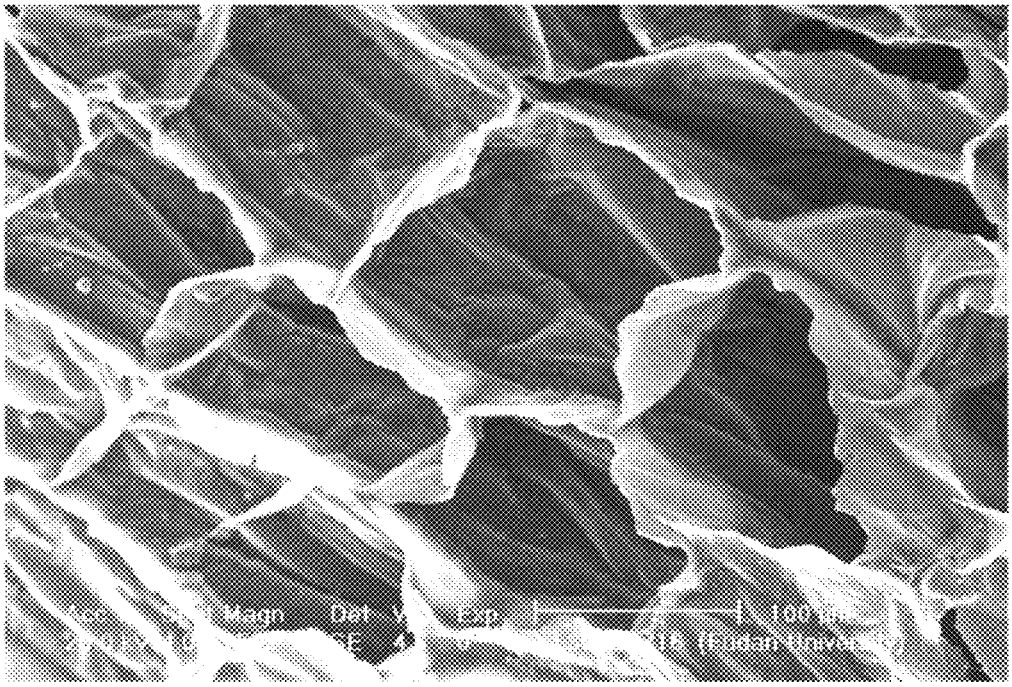
FIG. 1 is scanning electron microscope analysis of blank control cut stems.

A result of scanning electron microscope analysis of blank control cut stems is shown in FIG. 1.

2) Cut Stems Impregnated in 2 wt % $NaH_2PO_4$

Figure 2:
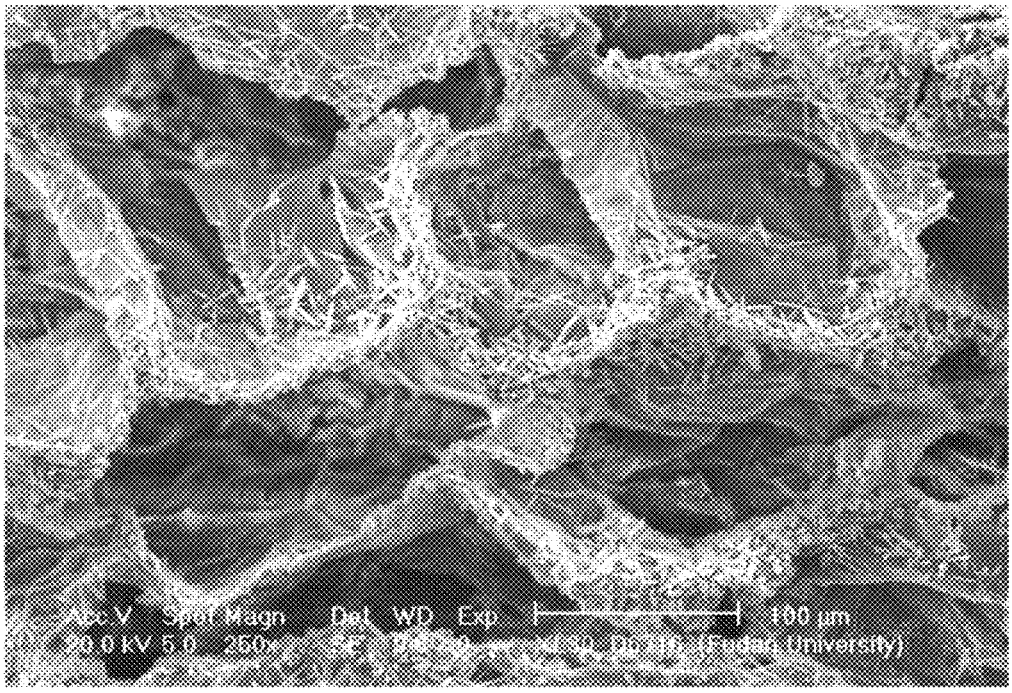
FIG. 2 is scanning electron microscope analysis of samples of cut stems impregnated in $NaH_2PO_4$.

Prepare an aqueous solution of 2 wt % $NaH_2PO_4$, and keep the aqueous solution temperature at 40° C. The cut stems of 10 g are impregnated in the solution for 1 min, then are taken out and dried, and placed in a constant temperature and humidity chamber, where humidity is 60% and temperature is 22° C., and keeps equilibrium for 48 h. An obtained result of scanning electron microscope analysis of the cut stems impregnated in $NaH_2PO_4$ is shown in FIG. 2.

3) Cut Stems Impregnated in 5 wt % Oxalic Acid

Figure 3:
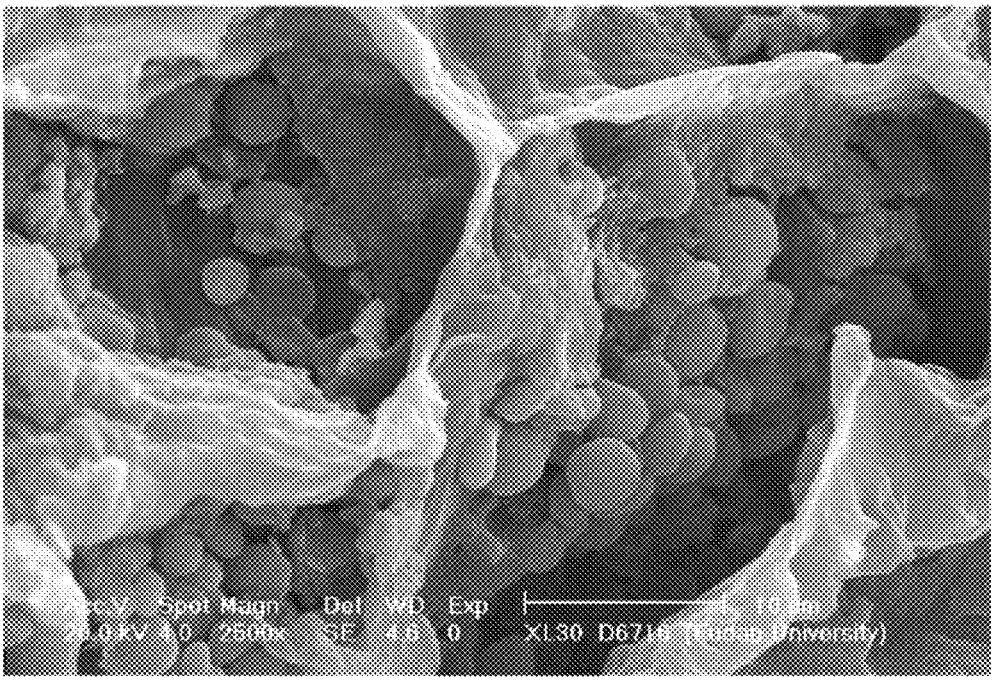
FIG. 3 is scanning electron microscope analysis of samples of cut stems impregnated in oxalic acid.

Prepare an aqueous solution of 5 wt % oxalic acid, and keep the aqueous solution temperature at 20° C. The cut stems of 10 g are impregnated in the solution for 0.5 min, then are taken out and dried, and placed in a constant temperature and humidity chamber, where humidity is 60% and temperature is 22° C., and keeps equilibrium for 48 h. An obtained result of scanning electron microscope analysis of the cut stems impregnated in oxalic acid is shown in FIG. 3.

4) Cut Stems Impregnated in 0.05 wt % Potassium Gluconate

Figure 4:
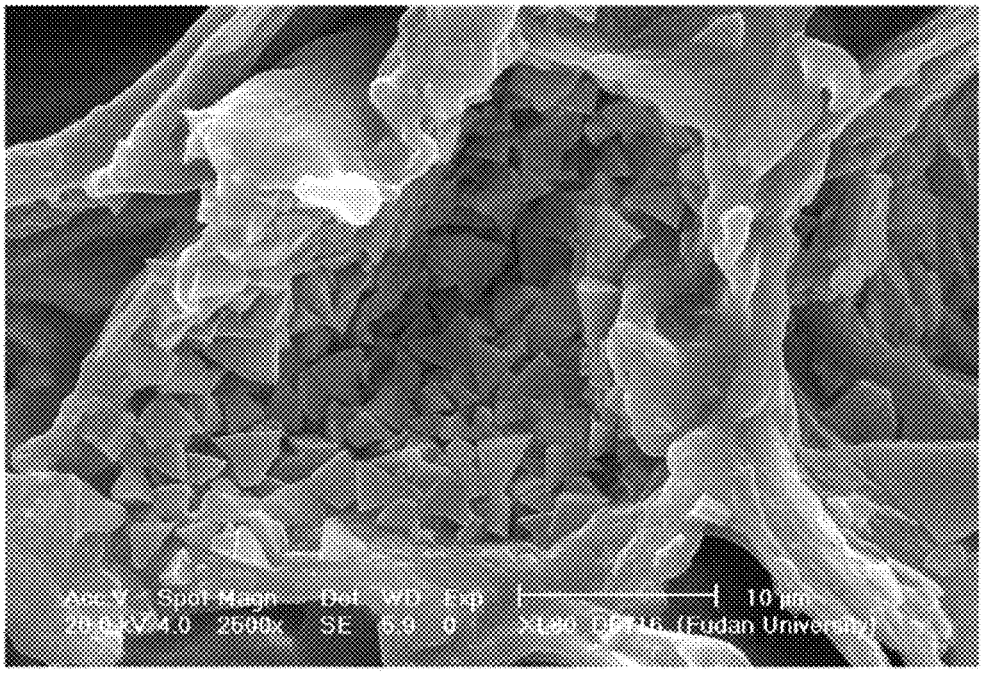
FIG. 4 is scanning electron microscope analysis of samples of cut stems impregnated in potassium gluconate.

Prepare an aqueous solution of 0.05 wt % potassium gluconate, and keep the aqueous solution temperature at 30° C. The cut stems of 10 g are impregnated in the solution for 5 min, then are taken out and dried, and placed in a constant temperature and humidity chamber, where humidity is 60% and temperature is 22° C., and keeps equilibrium for 48 h. An obtained result of scanning electron microscope analysis of the cut stems impregnated in potassium gluconate is shown in FIG. 4.

5) Loss-of-Water Analysis—Dynamic Moisture Sorption Analyzer

Weigh 1 g of the blank control cut stems, the obtained cut stems impregnated in 2 wt % $NaH_2PO_4$, cut stems impregnated in 5 wt % oxalic acid, and cut stems impregnated in 0.05 wt % potassium gluconate separately. Respectively place them in sample trays of the dynamic moisture sorption analysis system. Set RH=60%, and keep them at the room temperature for 120 min; next, set RH=30%, and keep them at the room temperature for 880 min. Finally, set 100° C. and RH=0, and keep them for 120 min. Calculate a dry basis, draw a curve diagram of dry basis moisture content with respect to time (for the comparison chart of cut stems impregnated in $NaH_2PO_4$-blank control cut stems, see FIG. 5; for the comparison chart of cut stems impregnated in oxalic acid-blank control cut stems, see FIG. 6; for the comparison chart of cut stems impregnated in potassium gluconate-blank control cut stems, see FIG. 7; and the time interval of automatically recording sample quality is 1 min) (RH is relative humidity).

As can be seen from FIG. 1, FIG. 2, and FIG. 3, a large quantity of crystals are filled on the surface of and inside the pores of the cut stems impregnated in $NaH_2PO_4$, oxalic acid, and potassium gluconate; it is found through EDX analysis that a needle-form crystal in the samples impregnated in $NaH_2PO_4$ is mono/di-calcium phosphate; it is found through EDX analysis that a ball-form crystal in the sample impregnated in oxalic acid is calcium oxalate; and it is found through EDX analysis that a triangle-form crystal in the samples impregnated in potassium gluconate is calcium gluconate.

Figure 5:
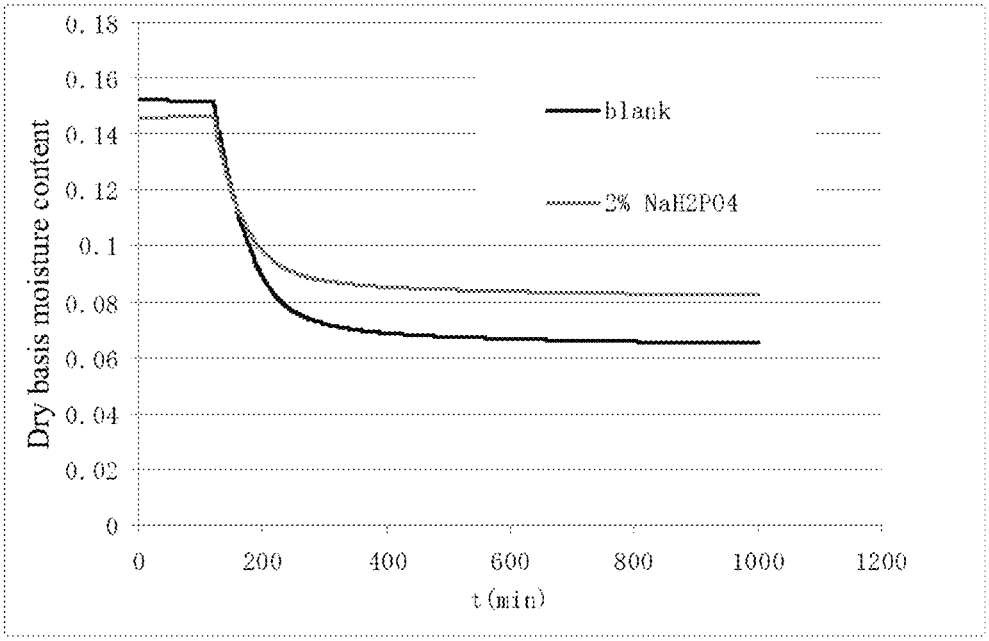
FIG. 5 is a loss-of-water curve comparison chart for blank control cut stems and samples of cut stems impregnated in $NaH_2PO_4$ at a humidity of 30%.
Figure 6:
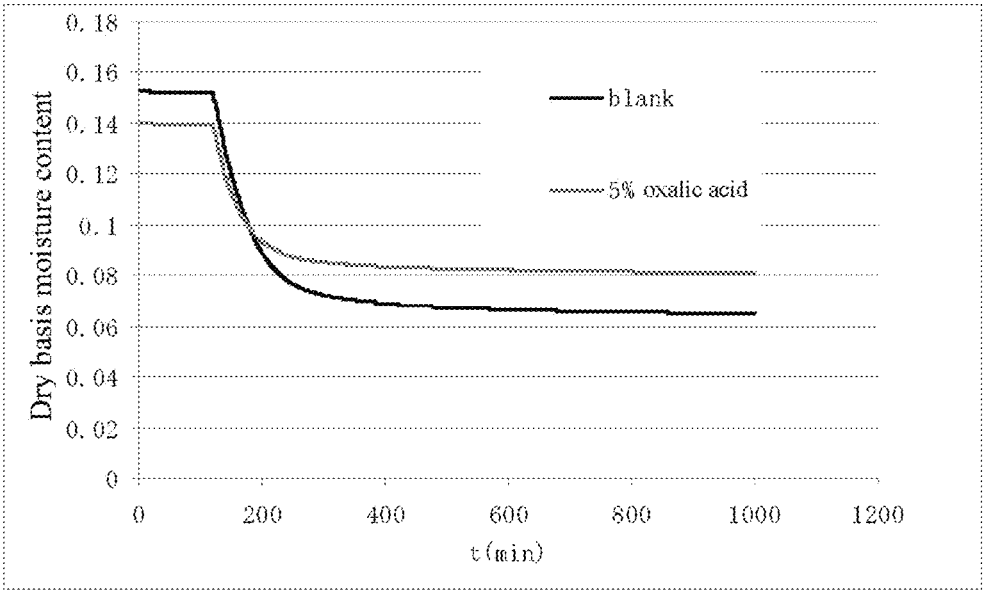
FIG. 6 is a loss-of-water curve comparison chart for blank control cut stems and samples of cut stems impregnated in oxalic acid at a humidity of 30%.
Figure 7:
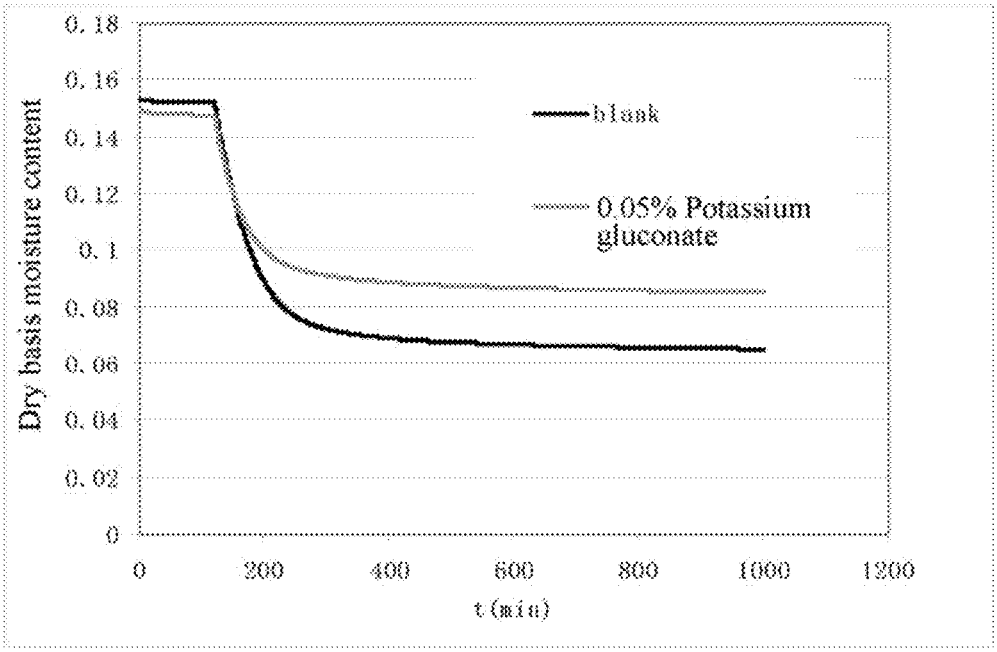
FIG. 7 is a loss-of-water curve comparison chart of blank control cut stems and samples of cut stems impregnated in potassium gluconate at a humidity of 30%.

As can be seen from FIG. 5, FIG. 6, and FIG. 7, the test samples have dry basis moisture content less than that of the blank control at humidity of 60%, whereas at humidity of 30%, the test samples have dry basis moisture content much greater than that of the blank control; therefore, the test samples show desirable moisture retention and moisture proof effects.

Embodiment 2

1) Cut Stems Impregnated in 1 wt % $(NH_4)_2HPO_4$

Prepare an aqueous solution of 1 wt % $(NH_4)_2HPO_4$, and keep the aqueous solution temperature at 40° C. The cut stems of 10 g are impregnated in the solution for 1 min, then are taken out and dried, and placed in a constant temperature and humidity chamber, where humidity is 60% and temperature is 22° C., and keeps equilibrium for 48 h. An obtained result of scanning electron microscope analysis of the cut stems impregnated in $(NH_4)_2HPO_4$ shows that a large quantity of crystals are filled on the surface of and inside the pores of the cut stems.

2) Cut Stems Impregnated in 3 wt % Lactic Acid

Prepare an aqueous solution of 3 wt % lactic acid, and keep the aqueous solution temperature at 40° C. The cut stems of 10 g are impregnated in the solution for 1 min, then are taken out and dried, and placed in a constant temperature and humidity chamber, where humidity is 60% and temperature is 22° C., and keep equilibrium for 48 h. An obtained result of scanning electron microscope analysis of the cut stems impregnated in lactic acid shows that a large quantity of crystals are filled on the surface of and inside the pores of the cut stems.

3) Cut Stems Impregnated in 0.5 wt % Potassium Citrate

Prepare an aqueous solution of 0.5 wt % potassium citrate, and keep the aqueous solution temperature at 40° C. The cut stems of 10 g are impregnated in the solution for 1 min, then are taken out and dried, and placed in a constant temperature and humidity chamber, where humidity is 60% and temperature is 22° C., and keep equilibrium for 48 h. An obtained result of scanning electron microscope analysis of the cut stems impregnated in potassium citrate shows that a large quantity of crystals are filled on the surface of and inside the pores of the cut stems.

4) Cut Stems Impregnated in 2 wt % Potassium Acetate

Prepare an aqueous solution of 2 wt % potassium acetate, and keep the aqueous solution temperature at 40° C. The cut stems of 10 g are impregnated in the solution for 1 min, then are taken out and dried, and placed in a constant temperature and humidity chamber, where humidity is 60% and temperature is 22° C., and keep equilibrium for 48 h. An obtained result of scanning electron microscope analysis of the cut stems impregnated in potassium acetate shows that a large quantity of crystals are filled on the surface of and inside the pores of the cut stems.

5) Cut Stems Impregnated in 2 wt % Sodium Malate

Prepare an aqueous solution of 2 wt % sodium malate, and keep the aqueous solution temperature at 40° C. The cut stems of 10 g are impregnated in the solution for 1 min, then are taken out and dried, and placed in a constant temperature and humidity chamber, where humidity is 60% and temperature is 22° C., and keep equilibrium for 48 h. An obtained result of scanning electron microscope analysis of the cut stems impregnated in sodium malate shows that a large quantity of crystals are filled on the surface of and inside the pores of the cut stems.

In conclusion, the present invention effectively overcomes various disadvantages in the prior art and has immense value in industrial use, and has desirable application potentials in the field of moisture retention for cigarettes.

The above embodiments are only to illustrate the principles and efficacy of the present invention, rather than to limit the present invention. Any person skilled in the art may make modifications and changes to the above embodiments without departing from the spirit and scope of the present invention. Therefore, any equivalent modifications or changes accomplished by a person of ordinary skill in the art without departing from the spirit and technical concept disclosed in the present invention shall still fall within the scope of the claims of the present invention.

What is claimed is:

1. A moistening method for tobacco stems, comprising steps of:

1) preparing a hydrated humectant for tobacco stem, 2) placing cut tobacco stems in the hydrated humectant to form impregnated cut tobacco stems;

3) taking out and drying the impregnated cut tobacco stems;

Wherein, the hydrated humectant for tobacco stem is a saline aqueous solution of $A_nB$, the $A_nB$ is NaH2PO4, potassium gluconate or oxalic acid, and each one of the $A_nB$ has a weight-percent concentration of 0.05 wt % to 5 wt %.

2. The moistening method for tobacco stems of claim 1, wherein the step 1) comprises steps:

(1a) preparing the aqueous solution of $A_nB$, (1b) adjusting the temperature of the saline solution of $A_nB$ obtained in step (1a) to 10° C. to 90° C.;

the step 2) comprises steps:

(2a) placing the cut tobacco stems in the saline solution of $A_nB$ obtained in step (1b) for impregnating, (2b) an impregnation duration is 0.5 min to 30 min, and a ratio of the weight of cut tobacco stems to the volume of the solution is g:L=1:10 to 1:100, wherein g is the weight of the cut tobacco stems in gram and L is the volume of the solution in liter;

the step 3) comprises steps:

(3a) taking out and drying the impregnated cut tobacco stems, (3b) placing the dried cut tobacco stems in a constant temperature and humidity chamber for 48 hours, and wherein in the constant temperature and humidity chamber a humidity is 57% to 63% and temperature is 20° C. to 24° C.

3. The moistening method for tobacco stems of claim 2, wherein the temperature of the solution obtained in step 1 in step (1b) is 20° C. to 40° C.

4. The moistening method for tobacco stems of claim 2, wherein the impregnation duration in step (2b) is 0.5 min to 5 min.

5. The moistening method for tobacco stems of claim 1, wherein the $A_nB$ is NaH2PO4, potassium gluconate or oxalic acid, and each one of the $A_nB$ has a weight-percent concentration of 0.05 wt % to 2 wt %.

* * * * *